US005628045A

United States Patent [19]

Lindner et al.

[11] Patent Number: 5,628,045

[45] Date of Patent: May 6, 1997

[54] PROCESS AND DEVICE FOR PRODUCING SINTERED PARTS

[75] Inventors: Karl-Heinz Lindner, Mülheim; Rudolf Schneider, Fröndenberg, both of Germany

[73] Assignees: Mannesmann Aktiengesellschaft, Düsseldorf; BT Magnet-Technologie GmbH, Herne, both of Germany

[21] Appl. No.: 659,948

[22] Filed: Jun. 7, 1996

[30] Foreign Application Priority Data

Jun. 7, 1995 [DE] Germany ..... 195 21 941.4

[51] Int. Cl.[6] ..... B22F 3/24

[52] U.S. Cl. ..... 419/25; 417/11; 417/57; 425/78; 432/152; 266/257

[58] Field of Search ..... 419/11, 25, 57; 425/78; 432/152; 266/257

[56] References Cited

U.S. PATENT DOCUMENTS

| | | | |
|---|---|---|---|
| 4,655,853 | 4/1987 | Byrnes et al. | 148/16.5 |
| 4,964,908 | 10/1990 | Greetham | 75/241 |
| 5,074,533 | 12/1991 | Frantz | 266/254 |
| 5,132,080 | 7/1992 | Pfeil | 419/2 |
| 5,312,574 | 5/1994 | Yamada et al. | 264/58 |

*Primary Examiner*—Charles T. Jordan
*Assistant Examiner*—Daniel Jenkins
*Attorney, Agent, or Firm*—Cohen, Pontani, Lieberman, Pavane

[57] ABSTRACT

A process for producing sintered parts with high wear resistance and good dynamic strength properties from formed bodies, which have been pressed as green parts from a completely-alloyed air-hardened heat-treatment steel powder with a carbon content of at least 0.3% added in the form of graphite. The process includes sintering the parts under protective gas at a sintering temperature of at least 1000° C. and subsequent cooling. The sintered parts are cooled immediately after sintering from the sintering temperature to a first holding temperature in the range of $Ar_3$ to a maximum of 150° C. above $Ar_3$ and are held for a first holding period of 5 to 25 minutes at this temperature (austenitizing phase). Immediately after this, the sintered parts are cooled in accelerated fashion to a second holding temperature by convective gas cooling and are held at this temperature for a second holding period. The second holding temperature lies in a temperature range in which a bainitic structure forms and is of such a length that a bainitic structure portion of at least 50% is established. The sintered parts are then cooled to room temperature.

12 Claims, 2 Drawing Sheets

PROCESS AND DEVICE FOR PRODUCING SINTERED PARTS

BACKGROUND OF THE INVENTION

1. Field of the Invention

The invention relates to a process for producing sintered parts with high wear resistance and, simultaneously, good dynamic strength properties from pressed formed bodies, as well as to a device for implementing this process.

2. Description of the Prior Art

Steel parts subjected to great mechanical stress, such as toothed gearwheels, not only must have high dimensional accuracy, but also must possess very good dynamic strength properties and high wear resistance. For a long time, it seemed that the only feasible way to manufacture parts of this type was by machining processes followed by case hardening. However, in order to reduce forming expense, it is also possible to use powder-metallurgical processes. In this context, it is known to form pressed bodies in the form of green bodies from a diffusion-alloyed oil-hardened steel powder to which, along with standard lubricants, graphite has been added in a quantity corresponding to the desired C content. The green bodies are then sintered in a continuous process in a furnace and subsequently cooled to room temperature. In order to improve dimensional accuracy, another pressing step is subsequently carried out on a calibrating press. After this, case hardening with quenching in oil is carried out, followed by a tempering treatment. The parts produced in this manner display a typical tempered structure.

A manufacturing process of this sort produces parts with good static properties (tensile strength, hardness, wear resistance) as well as good dynamic strength properties. However, despite the expense, which results from the second pressing step (calibration), the dimensional accuracy and the uniformity thereof occasionally leave something to be desired. The attainable tolerance class is approximately IT10.

Furthermore, it is known to produce sintered parts from pressed bodies that have been pressed from completely-alloyed, air-hardened steel powder. When this is done, a martensitic structure is produced by cooling in air to below the martensitic start temperature. Although sintered parts of this type, because of their great hardness, have good wear properties, they are unsuitable for dynamic types of stress, such as those regularly experienced by toothed gears, due to their ductile yield. Furthermore, sintered parts produced in this manner are often unsatisfactory in respect to the attainable dimensional accuracy (tolerance class IT9).

Finally, it is known from DE 40 01 899 C1 that, in order to produce high-strength sintered parts, green parts are pressed from completely-alloyed steel powder with an added mass share of 0.3 to 0.7% carbon in the form of graphite powder, sintered at a temperature in a range from 1120° to 1280° C., hardened by cooling and then tempered.

SUMMARY OF THE INVENTION

Accordingly, it is an object of the present invention to modify a process of the generic type so that significantly improved dimensional accuracy (tighter manufacturing tolerances) is attained, while good dynamic strength properties and, at the same time, good wear properties are also achieved, with process-related and equipment-related expense remaining as low as possible. A further object of the invention is to provide a device for implementing the process.

Pursuant to these objects, and others which will become apparent hereafter, one aspect of the present invention resides in a process for producing a sintered part with high wear resistance and good dynamic strength properties from a formed body which has been pressed as a green part from a completely-alloyed air-hardened heat-treatment steel powder with a carbon content of at least 0.3% added as graphite. The process includes sintering the part under protective gas at a sintering temperature of at least 1000° C.; immediately cooling the sintered part from the sintering temperature to a first holding temperature in a range of $Ar_3$ to a maximum of 150° C. above $Ar_3$ and holding the part at the first holding temperature for a first holding period of 5–25 min. Then the sintered part is cooled in an accelerated manner by convective gas cooling to a second holding temperature and the cooled part is held at this temperature for a second holding period. The second holding temperature lies in a temperature range in which a bainitic structure forms and the second holding period has a length so that the part has a bainite structure of at least 50%. Subsequently, the part is cooled to room temperature.

In another embodiment of the invention, the first holding temperature is at a maximum of 50°–100° C. above $Ar_3$. It is preferable that the first holding period is 10–20 min.

In yet another embodiment of the invention the convective gas cooling step is carried out at 3°–6° C./s. Furthermore, the cooling of the parts to the first holding temperature is carried out at 0.5°–1.5° C./s.

A further embodiment of the invention limits the second holding period so that the bainitic structure portion does not exceed 95%, preferably so that the bainitic structure portion is 60–80%.

In still another embodiment of the invention the protective gas atmosphere in the austenitizing phase is adjusted to a C potential that causes a carbonization of the sintered parts.

Another aspect of the invention resides in a device for implementing the inventive process. This inventive device includes an electronically controlled sintering furnace which is designed as a continuous unit. The sintering furnace has a sintering zone, a sudden cooling zone located behind the sintering zone and having gas cooling, and a conventional cooling zone located behind the sudden cooling zone. An austenitizing zone is located between the sintering zone and the sudden cooling zone while a bainitizing zone is located between the sudden cooling zone and the conventional cooling zone.

In yet another embodiment of the inventive device two conventional cooling zones are provided which are arranged parallel to one another relative to a material flow direction. One of the two conventional cooling zones is fed via a cross-transport device and the other conventional cooling zone is attached directly to the sudden cooling zone in order to permit optional detouring around the bainitizing zone.

Still another embodiment of the inventive device provides that the second conventional cooling zone and the bainitizing zone have a parallel transport direction opposite to the transport direction of the sintering zone, the austenitizing zone and the sudden cooling zone.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

The invention starts from the fact that in order to produce the sintered parts, use is made of a heat-treatment steel powder, known in itself, which is produced from a completely-alloyed steel, i.e., which has an even component distribution of alloy components (with the exception of the C content). It is therefore not necessary to first strive for an even component distribution during sintering by means of time-consuming diffusion steps. The separate heat treatment of sintered parts after sintering, which was previously required in order to establish good dynamic strength properties with simultaneous high wear resistance, is dispensed with. Instead, these properties are established directly in the course of the sintering treatment. To this end, it is essential that the steel powder used consist of an air-hardened material. This makes it unnecessary to use oil baths, which are undesirable for environmental reasons, in order to achieve a tempering effect.

The carbon content of the sintered parts is added separately in the usual manner in the form of graphite, so that the steel powder remains soft enough to ensure sufficient pressability. During the sintering process, the graphite diffuses into the powder particles, which are combining among themselves.

Figure 1:
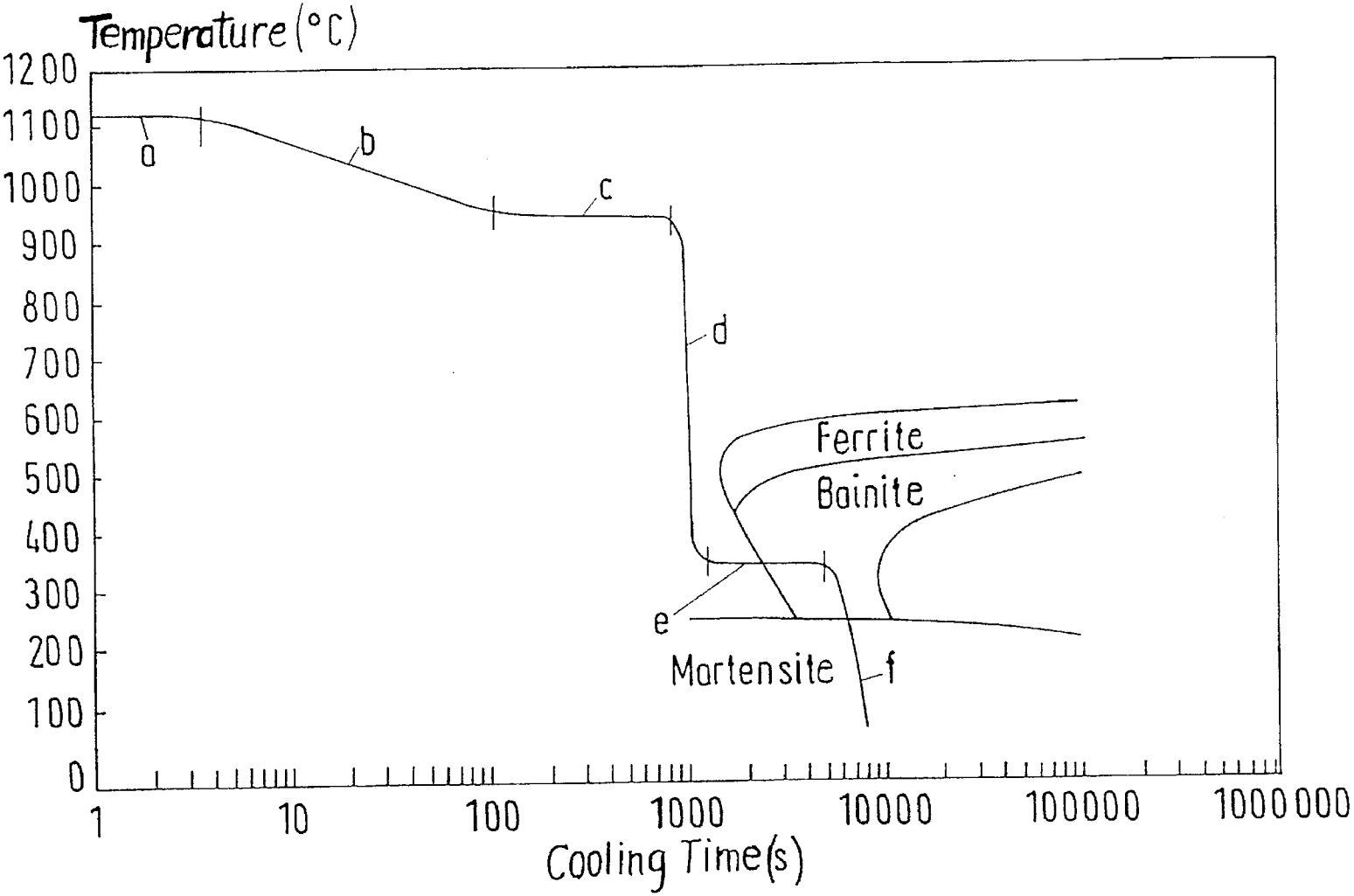
FIG. 1 is a schematic illustration of the process according to the invention in reference to a TTT diagram.

As FIG. 1 shows, the invention calls for the sintered parts to be cooled immediately after the sintering (Section a). Specifically, the parts are to be cooled from the sintering temperature to a first holding temperature, which lies in a temperature span from $Ar_3$ to a maximum of 150° C. above $Ar_3$. Cooling (Section b) from the sintering temperature to the first holding temperature is advantageously carried out at a cooling rate of 0.5°–1.5° C./s. The sintered parts are held at the first holding temperature for approximately 5–25 min (first holding period, Section c). As a result, a smaller austenitic grain size is achieved.

In the austenitizing phase (Section c), the C potential in the protective gas atmosphere needed during the sintering process is adjusted to an increased C potential that causes carburization. In this way, the external surface of the sintered parts becomes enriched with carbon, so that especially high hardness can be attained in the surface region. This is very significant for good wear resistance. In contrast, a lower carbon content is maintained in the interior of the sintered parts, which leads to especially good dynamic strength properties (hardness profile). It is especially advantageous to select the first holding temperature in the range of a maximum 50°–100° C. above $Ar_3$. Advantageously, the duration of the first holding period is 10–20 min.

Immediately following the first holding period, accelerated cooling (Section d) to a second holding temperature is carried out by means of convective gas cooling. A cooling rate in the range of 3°–6° C./s is recommended. The second holding temperature is selected in reference to the TTT diagram for the material in question so that the area of ferrite formation is avoided and a bainitic structure begins to form. The holding period at this second holding temperature (Section e) lasts at least until a bainitic structure portion of at least 50% has been established. However, complete transformation of the structure into bainite is generally not desirable. At the latest, holding at the second holding temperature should advantageously be ended at a maximum of 95% bainite. A bainitic portion on the order of 60–80% has proved especially advantageous. After this, the sintered parts are cooled in the usual manner to room temperature (normal cooling, Section f).

Surprisingly, it has been shown that especially good quality is achieved in the parts by means of the process according to the invention. Not only is comparatively high dimensional accuracy achieved, but the tolerances which occur are significantly tighter than those attained by conventional production methods. Instead of the quality class IT10 that could previously be attained with oil hardening and heat-treatment steel, it is now possible to achieve the quality class IT8. This is all the more surprising given the fact that it is even possible to omit the implementation of a separate calibrating step. This means that an entire expensive work step is dispensed with. Furthermore, the energy and handling expenditures for a separate heat-treatment process become unnecessary.

Figure 2:
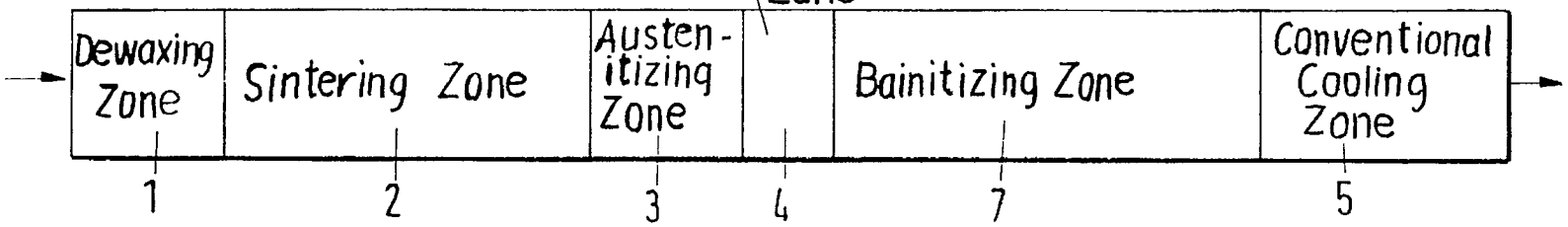
FIGS. 2 & 3 are schematic illustrations of a sintering furnace for carrying out the inventive process.

FIG. 2 schematically shows the device according to the invention, which is designed as an electronically controlled continuous sintering furnace, in its simplest form. An arrow at the left side indicates that the sintered parts are supplied to a first zone, which functions as a heating zone and in which the lubricants (e.g., waxes) contained in the green parts are flashed into steam. This first zone is therefore also called the dewaxing zone 1. Directly following zone 1 in the direction of transport is the actual sintering zone 2, where the sintered parts are held at sintering temperature (at least 1000° C.) over a sufficiently long time. Since the sintered parts move through the entire unit at a constant speed, the sintering zone 2 is of appropriate length. In order to avoid oxidation of the sintered parts, an oxygen-free atmosphere (protective gas atmosphere) is maintained throughout the entire unit. Directly after the sintering zone 2 comes an austenitizing zone 3, where the sintered parts are first cooled and then held at austenitizing temperature. After this comes a sudden cooling zone 4, which is equipped with a gas shower (not shown) suitable for effecting a sufficiently intensive convective gas cooling. As soon as the sintered parts have reached the second holding temperature, they enter a bainitizing zone 7 and are held at this temperature for a second holding period, which lasts long enough to allow a bainitic portion of at least 50% to form in the structure. The bainitizing zone 7 is of suitable length for this purpose. After sufficient bainitizing time, and if possible before the bainitic portion reaches 95%, the sintered parts enter an attached conventional cooling zone 5, where they are cooled from the bainitizing temperature to near room temperature.

Figure 3:
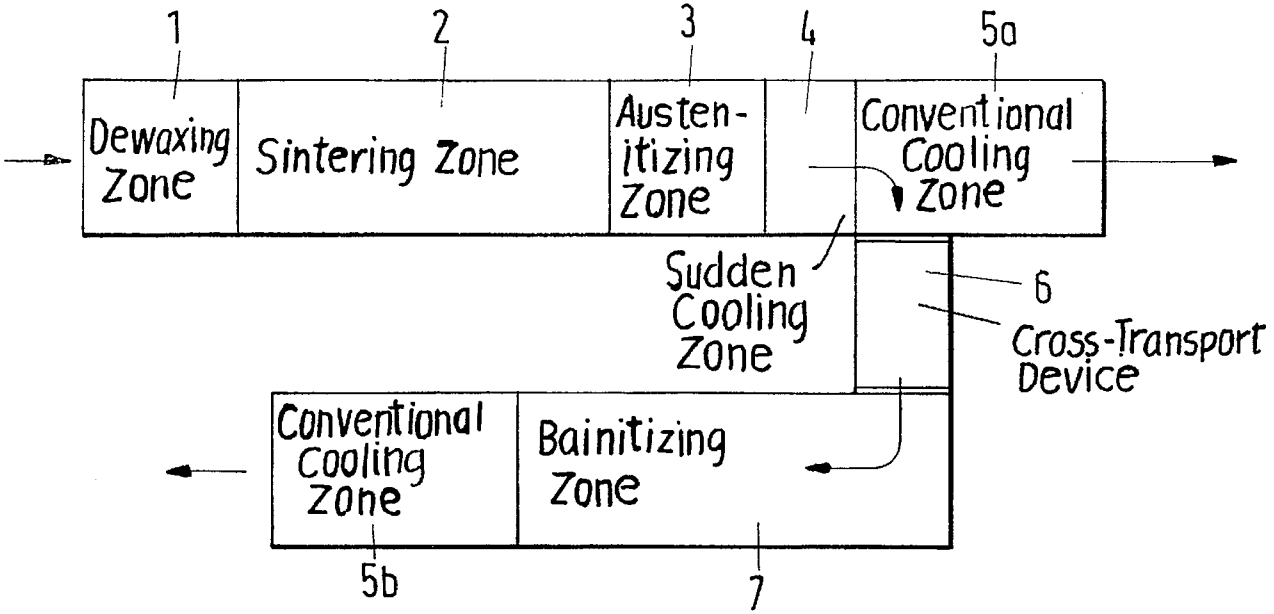

FIG. 3 shows a unit modified compared with that in FIG. 2. The unit in FIG. 3 differs in that the green parts used in the device can, as desired, be run along either of two different routes. From the dewaxing zone 1 to the sudden cooling zone 4, the arrangement in FIG. 3 corresponds to that in FIG. 2. However, after the sudden cooling zone 4, the direction of material flow can be chosen as desired. Either the produced sintered parts immediately enter a separate conventional cooling zone 5*a* and leave the machine as "normally" sintered parts, i.e., parts not produced in the manner according to the invention; or else the sintered parts, after leaving the sudden cooling zone 4, are fed via an optional attachable cross-transport device 6 (as indicated by the arrow) into a bainitizing zone 7, which is located parallel to the first section of the unit as a whole, in order to undergo the process sequence according to the invention.

Advantageously, the transport direction here is opposite to the first section of the device. After this, there once again follows a conventional cooling zone 5b, where the parts treated according to the invention are cooled to room temperature. This modified device therefore has two normal cooling zones. Such a unit thus offers particular flexibility with respect to the product spectrum being processed. Of course, it would also be possible to arrange the bainitizing zone 7 and the second conventional cooling zone 5b so that they are rotated by 180°, i.e., to retain the original direction of material flow. It would also be possible to simply interchange the arrangements of the conventional cooling zone 5a and the train formed by the bainitizing zone 7 and the conventional cooling zone 5b. However, the embodiment shown has the advantage of a relatively short structural length.

The effectiveness of the invention is explained with greater detail with reference to the following two examples.

Comparative Example

From a completely-alloyed steel powder of the composition Fe—4 Ni—0.5 Mo, to which, in elementary fashion, 1% Cu, 0.6% graphite and standard lubricants were added, pressed bodies with a thickness of 6.80–6.90 g/cm$^3$ were produced. The parts were sintered at a temperature of 1150° C. for 30 min. A protective gas atmosphere consisting of an endogas with controlled C potential was maintained. After convective gas cooling of the parts (at a cooling rate of 3°–6° C./s) to below the martensitic start temperature and subsequent normal cooling to room temperature, the following properties were found:

| | |
|---|---|
| tensile strength | 650 N/mm$^2$ |
| hardness level | 550–700 HV1 |
| ductile yield A3 | 0.3–0.6% |

Dimensional accuracy corresponded to tolerance class IT9.

Example According to the Invention

From a completely-alloyed steel powder of the composition Fe—4 Ni—0.5 Mo, to which were added 1% Cu, 0.6% graphite and standard lubricants, pressed bodies of the same type as in the previous example were produced. Sintering was carried out at a temperature of 1120° C. for 30 min in an endogas atmosphere with controlled C potential. After austenitizing, sudden cooling at a cooling rate of 3° C./s as well as bainitizing according to the invention were carried out, followed by normal cooling to room temperature. A bainitic structure was established in the parts with the following properties:

| | |
|---|---|
| tensile strength | 750–800 N/mm$^2$ |
| hardness level | 350–450 HV1 |
| ductile yield A3 | to 6% |

In addition, the dimensional accuracy of the parts produced according to the invention was significantly better. It corresponded to tolerance class IT8.

The process according to the invention makes it possible to simultaneously combine, in components in the sintered state, high ductility with high strengths, which otherwise could not be reached even with a separate heat treatment, while attaining a clearly improved dimensional tolerance.

The invention is not limited by the embodiments described above which are presented as examples only but can be modified in various ways within the scope of protection defined by the appended patent claims.

We claim:

1. A process for producing a sintered part with high wear resistance and good dynamic strength properties from a formed body which has been pressed as a green part from a completely-alloyed air-hardened heat-treatment steel powder with a carbon content of at least 0.3% added as graphite, the process comprising the steps of:

sintering the part under protective gas at a sintering temperature of at least 1000° C.;

immediately cooling, the sintered part from the sintered temperature to a first holding temperature in a range of $Ar_3$ to a maximum of 150° C. above $Ar_3$ and holding the part at the first holding temperature for a first holding period of 5–25 minutes;

cooling the sintered part in an accelerated manner by convective gas cooling to a second holding temperature and holding the cooled part at this temperature for a second holding period, the second holding temperature lying in a temperature range in which a bainitic structure forms, the second holding period having a length so that the part has a bainite structure portion of at least 50%; and subsequently cooling the part to room temperature.

2. A process as defined in claim 1, wherein the step of cooling the part to a first holding temperature includes cooling to a first holding temperature at a maximum of 50°–100° C. above $Ar_3$.

3. A process as defined in claim 1, wherein the step of cooling the part to a first holding temperature includes holding the part at the first holding temperature for a period of 10–20 minutes.

4. A process as defined in claim 1, wherein the convective gas cooling step is carried out at 3°–6° C./s.

5. A process as defined in claim 1, wherein the step of cooling the part to the first holding temperature is carried out at 0.5°–1.5° C./s.

6. A process as defined in claim 1, wherein the convective gas cooling step includes holding the part at the second holding temperature for a period so that the bainitic structure portion is no more than 95%.

7. A process as defined in claim 6, convective gas cooling step includes holding the part at the second holding temperature so that the bainitic structure portion is 60–80%.

8. A process as in claim 1, including adjusting the protective gas atmosphere to a C potential that causes a carburization of the sintered part.

9. A device for producing a sintered part with high wear resistance and good dynamic strength properties from a formed body which has been pressed as a green part from a completely-alloyed air-hardened heat-treatment steel powder with a carbon content of at least 0.3% added as graphite, comprising:

an electronically controlled sintering furnace having a sintering zone, a sudden cooling zone located behind the sintering zone and having gas cooling, and a conventional cooling zone located behind the sudden cooling zone;

an austenitizing zone arranged between the sintering zone and the sudden cooling zone; and a bainitizing zone arranged between the sudden cooling zone and the conventional cooling zone.

10. A device as defined in claim 9, and further comprising an additional conventional cooling zone, the conventional cooling zones being arranged parallel to one another relative to a material flow direction, and still further comprising a cross-transport device arranged so as to feed one of the two conventional cooling zones, the other of the conventional cooling zones being directly attached to the sudden cooling zone so as to permit selective avoidance of the bainitizing zone.

11. A device as defined in claim 10, wherein the cross-transport device is arranged between the sudden cooling zone and the bainitizing zone.

12. A device as defined in claim 11, wherein the additional conventional cooling zone and the bainitizing zone have a parallel transport direction opposite to a transport direction of the sintering zone, the austenitizing zone and the sudden cooling zone.

* * * * *